US006848581B2

(12) United States Patent
Cohen

(10) Patent No.: US 6,848,581 B2
(45) Date of Patent: Feb. 1, 2005

(54) CASE FOR TRANSPORTING AND ORGANIZING MEDICATION

(76) Inventor: Richard Cohen, 15 E. Park, Arlington Heights, IL (US) 60005

( * ) Notice: Subject to any disclaimer, the term of this patent is extended or adjusted under 35 U.S.C. 154(b) by 0 days.

(21) Appl. No.: 10/135,660

(22) Filed: Apr. 30, 2002

(65) Prior Publication Data

US 2002/0179609 A1 Dec. 5, 2002

Related U.S. Application Data

(60) Provisional application No. 60/294,167, filed on May 29, 2001.

(51) Int. Cl.[7] ..... B65D 83/04

(52) U.S. Cl. ..... 206/534; 190/110; 206/523; 206/538; 206/570

(58) Field of Search ..... 206/803, 534, 206/538, 523, 570, 539, 528, 524; 190/109, 16, 110, 111; 220/4.22, 524, 528, 532, 533

(56) References Cited

U.S. PATENT DOCUMENTS

| | | | | | |
|---|---|---|---|---|---|
| 513,044 | A | * | 1/1894 | Handlan, Jr. | 220/528 |
| 1,644,830 | A | * | 10/1927 | Henderson | 312/209 |
| 1,705,149 | A | * | 3/1929 | Brady | 190/111 |
| 4,106,597 | A | * | 8/1978 | Shook et al. | 190/110 |
| 4,749,085 | A | * | 6/1988 | Denney | 206/534 |
| 4,852,293 | A | * | 8/1989 | Levine et al. | 43/54.1 |
| 5,351,818 | A | * | 10/1994 | Daneshvar | 206/216 |
| 5,482,342 | A | * | 1/1996 | Kowalski et al. | 294/160 |
| 5,558,229 | A | * | 9/1996 | Halbich | 206/534 |
| 5,676,240 | A | | 10/1997 | Cziraky et al. | |
| D389,639 | S | | 1/1998 | Priebe | |
| 5,881,850 | A | * | 3/1999 | Murdoch | 190/110 |
| 5,934,018 | A | * | 8/1999 | Thomas | 47/87 |
| 5,938,064 | A | * | 8/1999 | Smith, Jr. | 220/475 |
| 5,938,068 | A | * | 8/1999 | Atkins et al. | 220/839 |
| D415,958 | S | | 11/1999 | Noble | |
| D416,196 | S | | 11/1999 | Noble | |
| 6,015,064 | A | * | 1/2000 | Liu | 220/524 |
| 6,196,412 | B1 | * | 3/2001 | Cattell | 220/524 |

* cited by examiner

*Primary Examiner*—Joseph C. Merek
(74) *Attorney, Agent, or Firm*—Marshall, Gerstein & Borun LLP

(57) ABSTRACT

A carrying case for carrying and organizing medication is disclosed. The carrying case comprises a first compartment and second compartment, with the first and second compartments relatively foldable along a common fold line between an open position and a closed position. The first and second compartments are disposed in face-to-face relationship when the first and second compartments are in the closed position. A plurality of slots are defined in at least one of the compartments, and a plurality of inserts are provided. Each of the inserts is sized for insertion into a corresponding one of the slots, with each of the inserts having at least one closeable chamber. A divider panel is provided, with the divider panel mounted for shiftable movement between a folded position in which the divider panel is disposed over at least one of the compartments and an unfolded position in which the divider panel permits access to the at least one compartment.

9 Claims, 12 Drawing Sheets

CASE FOR TRANSPORTING AND ORGANIZING MEDICATION

RELATED APPLICATIONS

This application claims priority from U.S. Provisional Application Ser. No. 60/294,167, filed May 29, 2001.

FIELD OF THE INVENTION

The present invention relates generally to carrying cases. More specifically, the present invention relates to a carrying case that permits medication, such as prescription medication, and/or vitamins or supplements, to be transported in bulk and to be organized into discrete dosages.

BACKGROUND OF THE INVENTION

Many people must take a number of prescription medications on a daily basis. In fact, many people must take multiple doses of a number of different medications every day. The task of organizing and tracking the daily doses is often daunting. This task is made even more difficult by the fact that some of the medications must be taken, for example, one time per day, while other medications must be taken two, three, or more times per day. Of course, care must be taken not to miss a dose or duplicate a dose. Organizing and tracking vitamins and supplements present the same problems.

It is one thing to organize and track various medications, vitamins, and/or supplements at home. However, much of this organization may fall by the wayside when a person travels, as people often just throw all of their medications into a bag. Another problem is presented by the fact that many people see more than one doctor, each of which has or will prescribe different medications. In order to protect against drug interaction, a doctor must know about all of the medications a patient is taking, and in what doses. In many circumstances, patients may not recall with a great deal of accuracy all of the medications they may be taking, and in what doses. The foregoing concerns are merely exemplary.

DETAILED DESCRIPTION OF THE PREFERRED EMBODIMENT

The following description of the disclosed embodiment is not intended to limit the scope of the invention to the precise form or forms detailed herein. Instead, the following description is intended to be illustrative of the principles of the invention so that others may follow its teachings.

Figure 1:
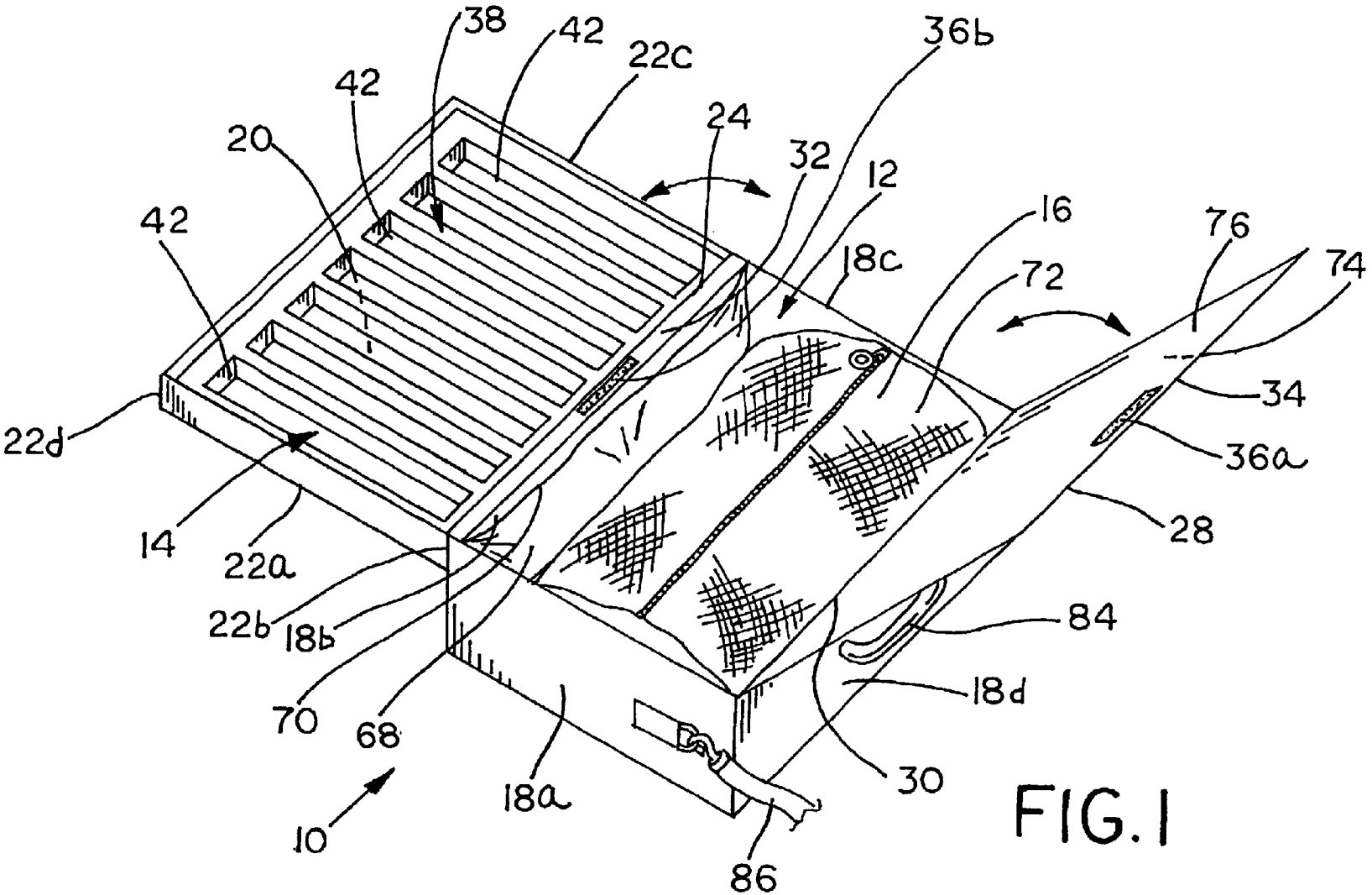
FIG. 1 is a perspective view of a portable medicine organizing and carrying case assembled in accordance with the teachings of the present invention.
Figure 2:
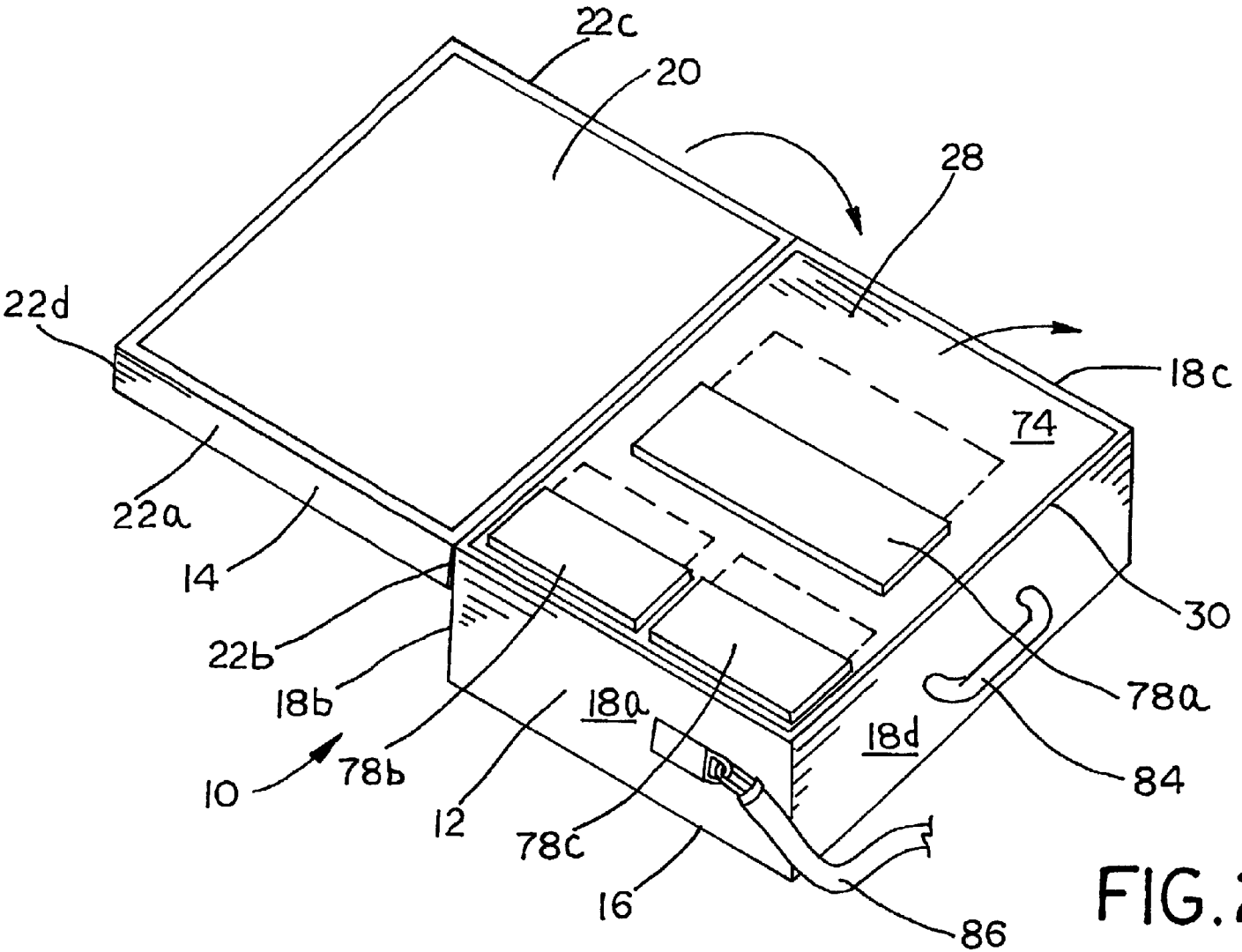
FIG. 2 is a perspective view similar to FIG. 1 but illustrating the divider panel folded to cover one of the compartments.

Referring now to the drawings, a portable medicine organizing and carrying case assembled in accordance with the teachings of the present invention is generally referred to by the reference numeral 10. As shown in FIGS. 1 and 2, the carrying case 10 includes a first compartment 12 and a second compartment 14. The first compartment 12 includes a bottom wall 16 (obscured in FIG. 1 but visible in FIG. 5) and surrounding sidewalls 18*a*, 18*b*, 18*c* and 18*d*. The second compartment 14 includes a bottom wall 20 (obscured in FIG. 1 but visible in FIGS. 2 and 5) and surrounding sidewalls 22*a*, 22*b*, 22*c* and 22*d*. The first and second compartments 12, 14 are relatively foldable along a common hinge line 24 between the open position of FIGS. 1 and 2, and the closed position of FIG. 3.

A closing device 26 (FIG. 3) is provided for securing the carrying case 10 in the closed position. In the disclosed embodiment, the closing device 26 is a zipper which extends along the interface 27 between the first and second compartments 12 and 14. Alternatively, other suitable closing devices may be employed, such as, by way of examples and not limitations, snaps, straps, buckles, hook and loop closures, or other suitable mechanisms. Further, in the disclosed embodiment, the exterior of the case may be constructed of 70D PVC material, such as is available from Custom Creative Products of Carpinteria, Calif.

Referring again to FIGS. 1 and 2, a divider panel 28 is joined to the compartment 12 along a hinge line 30. In the embodiment shown, the divider panel is joined to the sidewall 18*d*. Alternatively, the divider panel may be joined to any one of the remaining sidewalls 18*a*, 18*b* and 18*c*. As a further alternative, the divider panel 28 may be pivotally joined by a suitable hinge to any one of the sidewalls 22*a*–*d* of the second compartment 14. A support 32 is provided inside the first compartment 12. The support 32 is positioned within the compartment 12 to provide support for a free edge 34 of the divider panel 28 when the divider panel 28 is in the position of FIG. 2. Preferably, the support 32 and the free edge 34 of the divider panel 28 will include corresponding hook and loop closures 36*a*, 36*b*, respectively, which help to secure the divider panel 28 in the position of FIG. 2.

Figure 7:
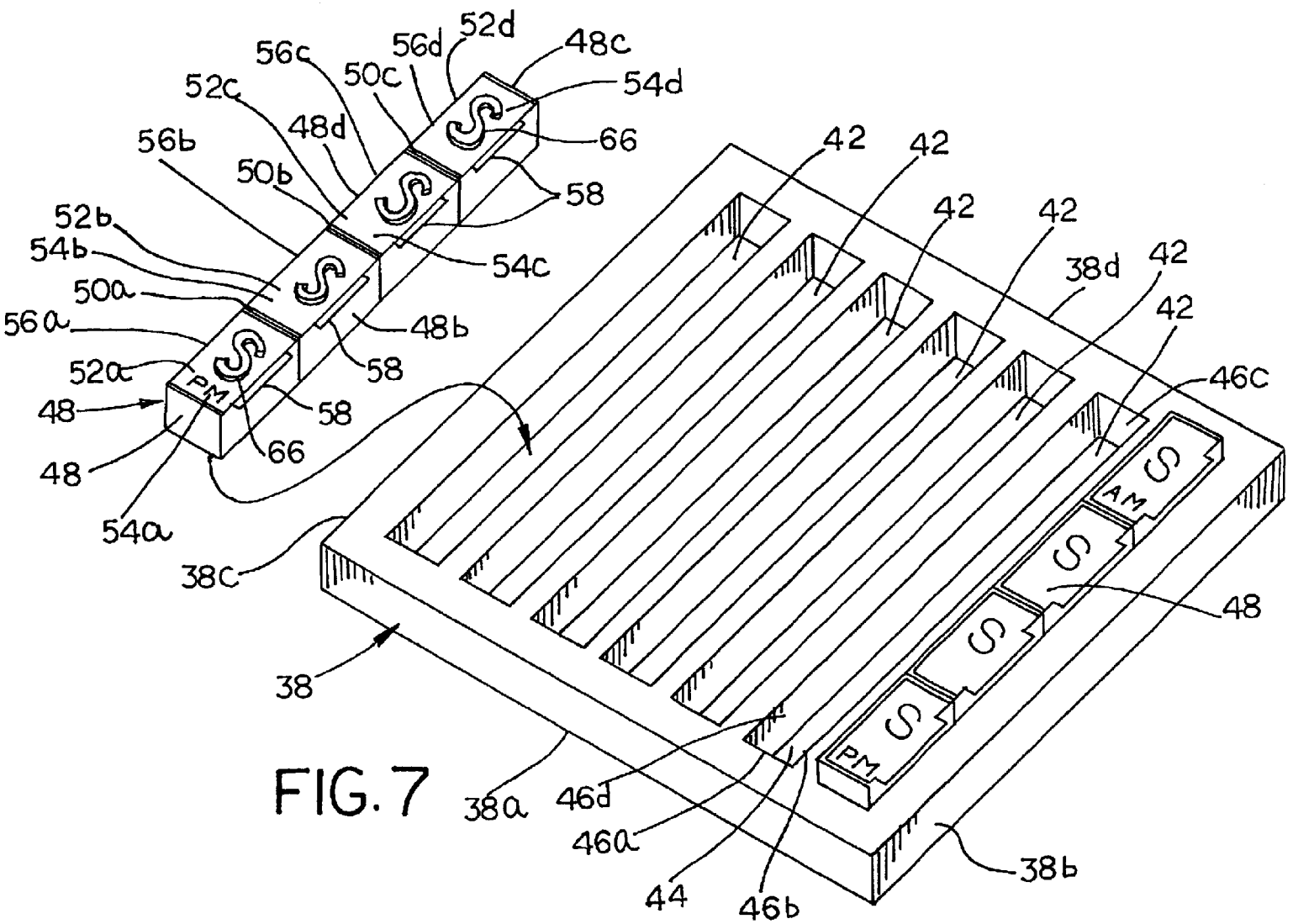
FIG. 7 is a fragmentary and partially exploded view in perspective of a foam insert having slots for receiving one or more pill inserts, and further showing one pill insert disposed in one of the slots and another pill insert removed from one of the slots.

Referring now to FIG. 7, a slotted member 38 is shown. The slotted member 38 includes a plurality of edges 38*a*, 38*b*, 38*c* and 38*d*, and is sized to be removably received in the second compartment 14. In the disclosed embodiment, the slotted member 38 is frictionally secured in place in the second compartment 14 by friction between the sidewalls 38*a–d* and the surrounding sidewalls 22*a–d* of the second compartment 14. Alternatively, the slotted member 38 may be secured to the second compartment by a hook and loop closure (not shown) or other suitable fastener (not shown). Further, in the disclosed embodiment the slotted member is constructed of foam, such as a polyurethane foam or any other suitable foam material.

The slotted member 38 includes a plurality of slots 42, which in the disclosed embodiment are substantially identical. Although in the illustrated device 10, seven slots 42 are provided, they are identical and, thus, only a single one of the slots 42 will be described in detail. The slot 42 includes a bottom wall 44 and a plurality of surrounding sidewalls 46*a*, 46*b*, 46*c* and 46*d*. Alternatively, depending on the depth of the slotted member 38, the bottom wall 44 may be defined by a portion of the bottom wall 20 of the second compartment 14. Each of the slots 42 is sized to receive a pill insert 48. Each of the pill inserts 48 includes a plurality of sidewalls 48*a*–48*d*. In FIG. 7, one such pill insert 48 is shown inserted in one of the slots 42, while another such pill insert 48 is shown removed from the slotted member 38. In the disclosed embodiment, the pill inserts 48 are frictionally secured in place in their corresponding slots 42 by friction between at least some of the sidewalls 44*a–d* of the slots 42 and at least some of the surrounding sidewalls 48*a–d* of the pill inserts 48. Each of the pill inserts 48 includes a plurality of interior walls, for example, interior walls 50*a*, 50*b* and 50*c*, thus dividing each pill insert 48 into a plurality of chambers, for example, chambers 52*a*, 52*b*, 52*c* and 52*d*. As an alternative, greater or fewer interior walls may be employed, thus dividing the pill insert 48 into greater or fewer chambers. Each chamber 52*a–d* includes a top wall 54*a–d*, respectively, which is openable along a hinge line 56*a–d*, respectively. Each of the top walls 54*a–d* will preferably include an extended portion 58.

Referring now to FIGS. 8–11, a representative chamber 52 is shown.

Figure 10:
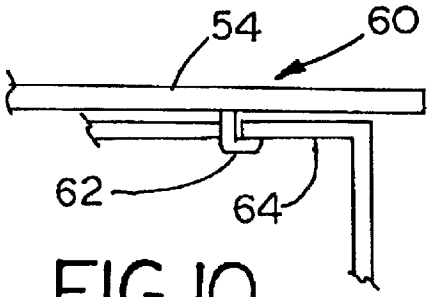
FIG. 10 is an enlarged fragmentary cross-sectional view taken along line 10—10 of FIG. 8.
Figure 9:
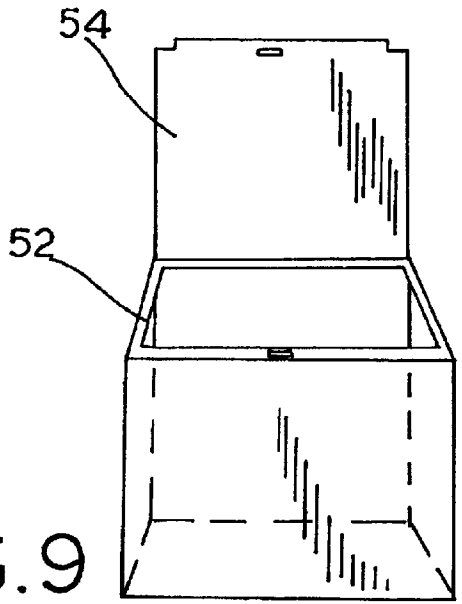
FIG. 9 is another fragmentary view in perspective of the pill insert shown in FIG. 8.
Figure 8:
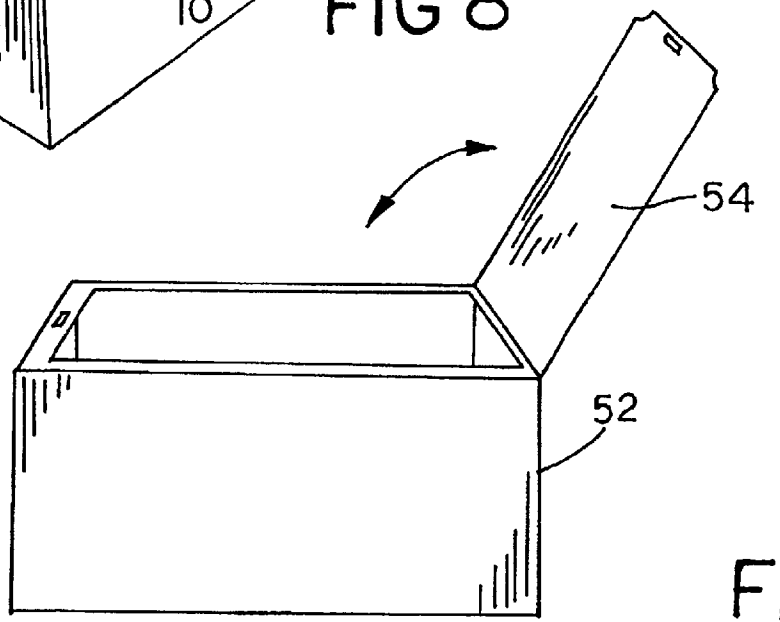
FIG. 8 is a fragmentary view in perspective of a pill insert.
Figure 11:
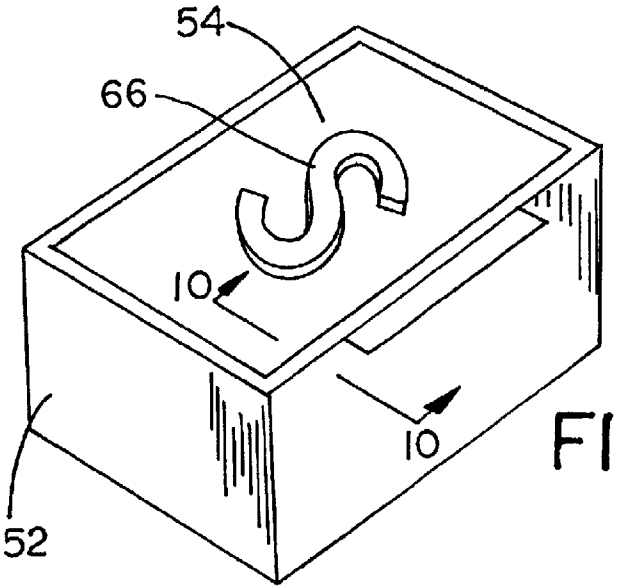
FIG. 11 is another fragmentary view in perspective of the pill insert shown in FIGS. 8 and 9.

As shown in FIG. 10, the underside of each of the top walls 54 may include a latch 60, which in the disclosed embodiment is a hook 62 which engages a flange 64. It will be understood that the pill inserts 48 may take the form of a continuous insert (i.e., an insert having four chambers as shown in FIG. 7), or else the inserts 48 may be comprised of four individually formed chambers 52, such as the individual chambers 52 is shown in FIGS. 8, 9 and 11.

Preferably, each insert 48 (or each individual chamber 52) will have indicia 66 (FIGS. 7, 8, 12 and 14) imprinted or otherwise formed thereon. In the disclosed embodiment, the indicia 66 is printed or formed on each of the top walls 54*a–d*. According to the disclosed embodiment, each of the inserts 48 will have indicia indicative of separate days of the week (e.g., Sunday through Saturday). Still preferably, the indicia 66 on each of the top walls 54*a–d* of the chambers 52*a–d* may be indicative of different times of the day (e.g., a.m., p.m., and other suitable times such as noon, etc.).

Figure 5:
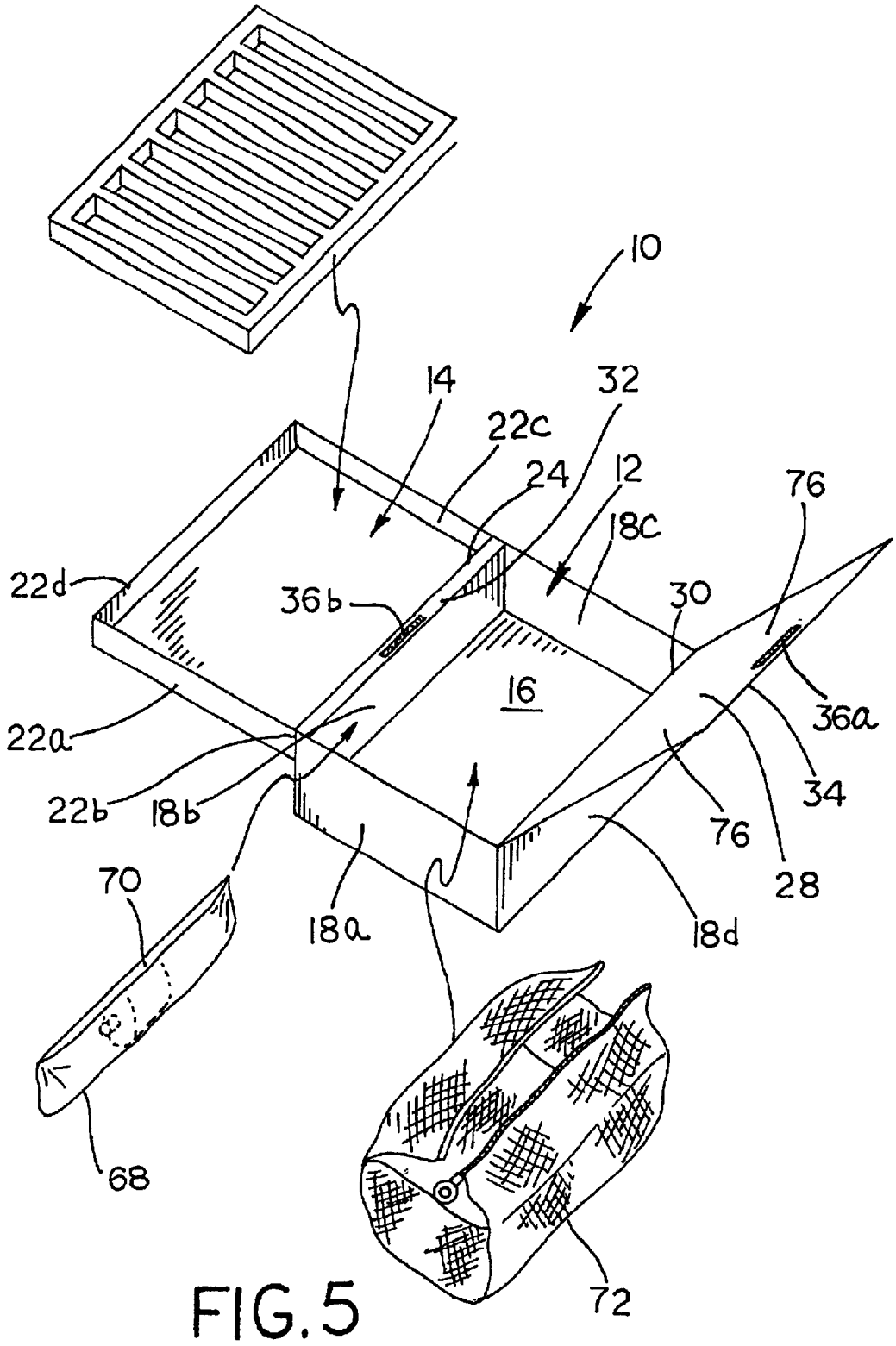
FIG. 5 is an exploded view in perspective of the carrying case illustrated in FIGS. 1 and 2.

Referring now to FIG. 5, a pouch 68 may be provided in the first compartment 12. In the disclosed embodiment, the pouch is preferably a flexible waterproof plastic pouch having an elastic strip 70, such that the pouch 68 will safely hold liquid medications (shown in phantom in FIG. 5) therein. The pouch will preferably be secured along one of the sidewalls 18*b* of the first compartment 12, such as by using hook and loop closures or other suitable securement means. A medication bag 72 maybe provided, which in the disclosed embodiment is constructed of a nylon mesh material.

Figure 6:
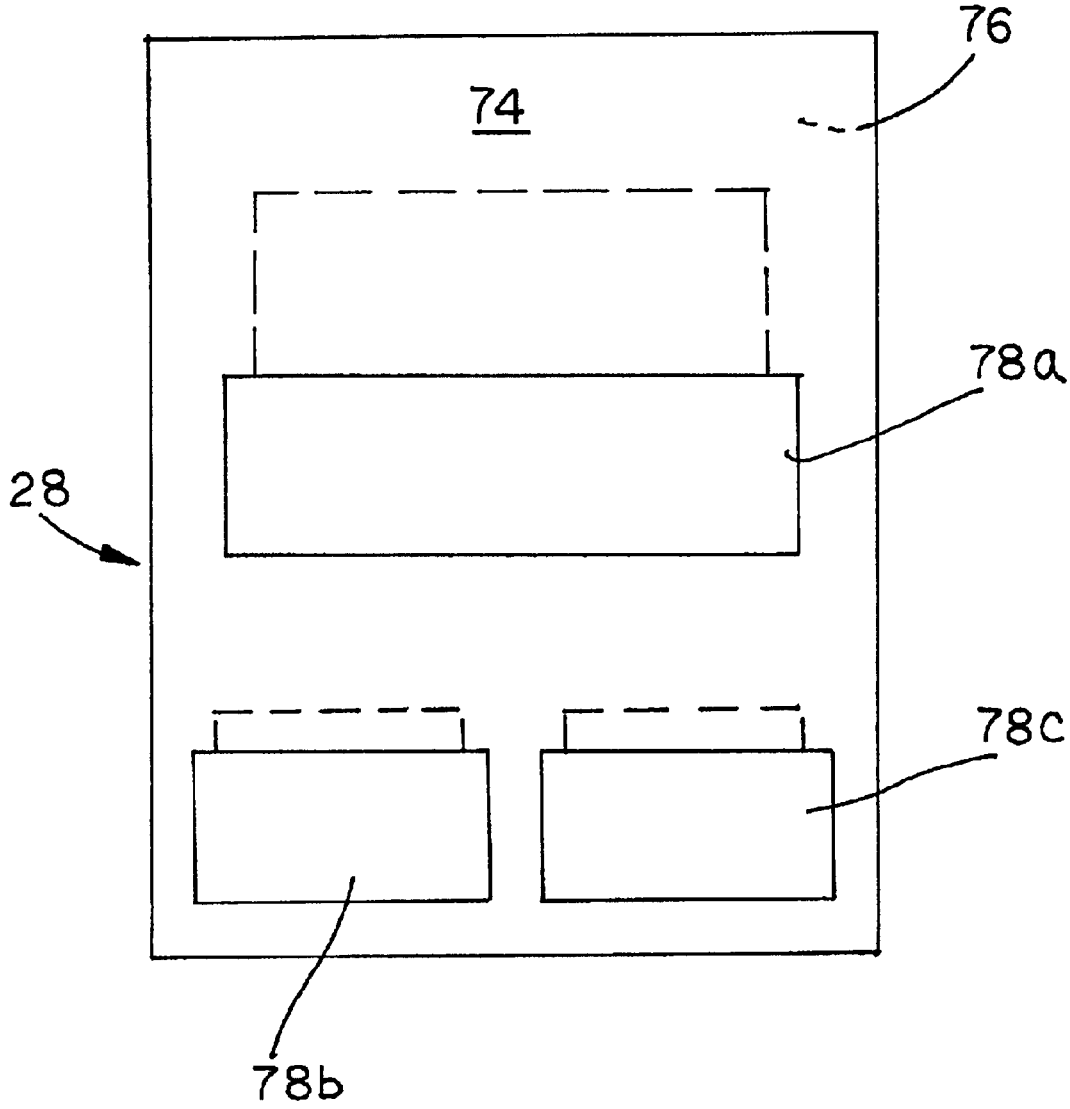
FIG. 6 is a fragmentary elevational view illustrating one side of the divider panel.

Referring now to FIG. 6, the divider panel 28 includes a pair of faces 74, 76, (the face 76 is visible in FIGS. 1 and 5). At least one of the faces, e.g., the face 74, may include one or more pouches or pockets 78*a*–78*c*. Each of the pockets 78*a–c* is sized to receive written material, such as, by way of examples and not limitations, appointment cards, business cards, medical history information, drug interaction information, and other suitable types of information.

Figure 12:
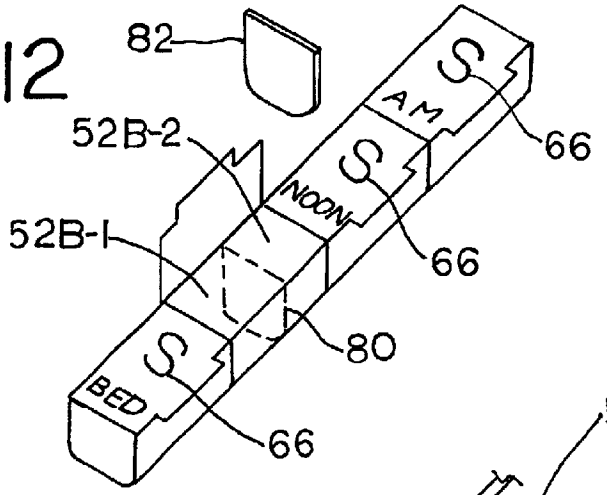
FIG. 12 is a perspective view of a pill insert having an optional wall divider wall panel.
Figure 13:
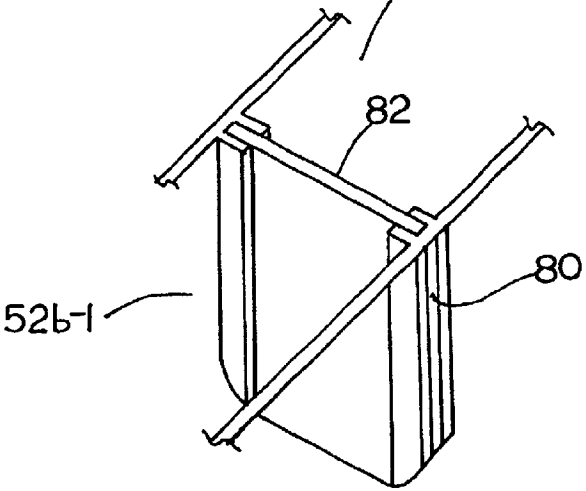
FIG. 13 is an enlarged fragmentary view in perspective of the divider wall panel of FIG. 12 received in an internal slot.
Figure 14:
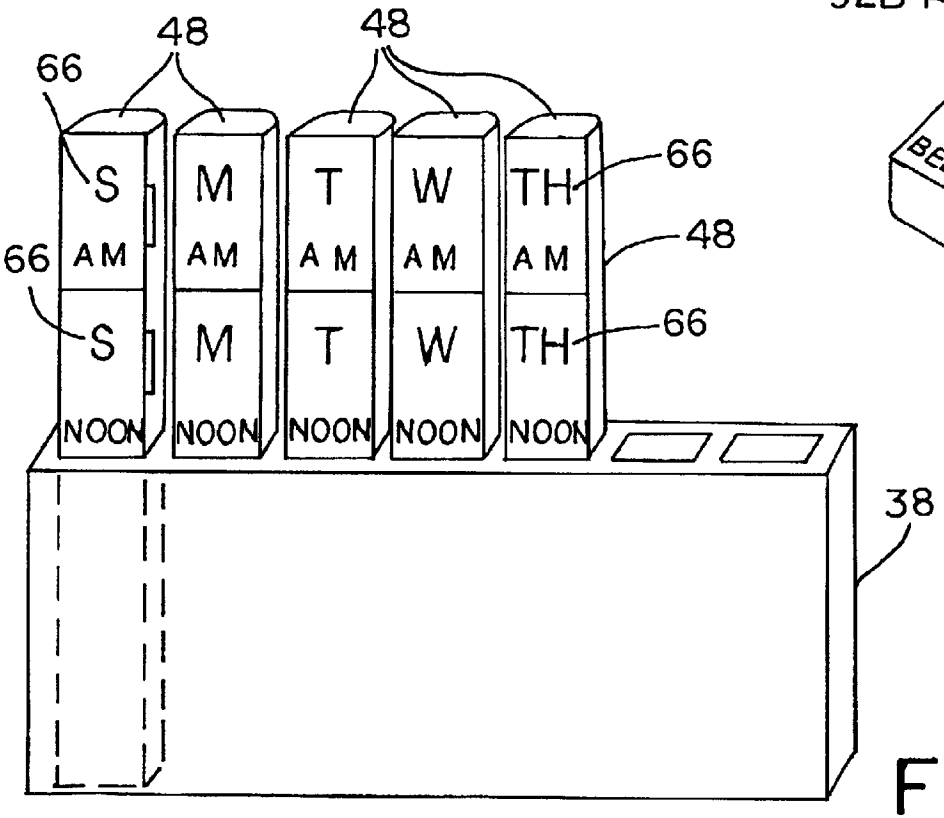
FIG. 14 is a perspective view of an alternate form for the slotted member for receiving the pill inserts.

Referring now to FIGS. 12 and 13, at least one of the chambers, e.g., the chamber 52*b* in the example shown, may include an internal slot 80 which receives a separate wall panel 82, thus dividing the chamber 52*b* into two subchambers 52*b*-1 and 52*b*-2.

Optional clear or translucent flexible flaps 139 (FIGS. 17 and 18) may be provided over either or both of the first and second compartments 12, 14. Such clear and flexible flaps 139 may be constructed of commercially available materials, such as, by way of example rather than limitation, clear vinyl. A mesh material may be used as well. The flexible flap 139 may also be translucent, or alternatively, opaque (although if opaque the flap may, depending on its size, obstruct the user's view). Further, a handle 84 and/or a shoulder strap 86 may be provided (FIGS. 2 and 3).

Figure 3:
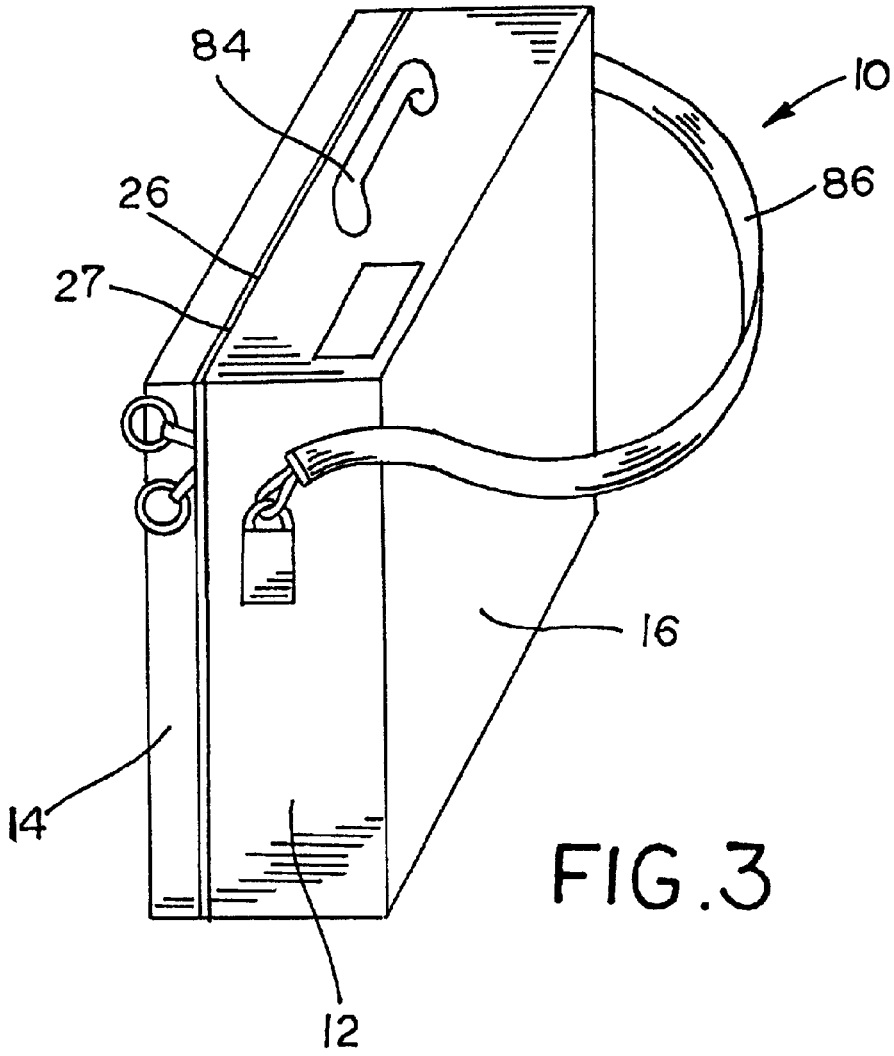
FIG. 3 is a perspective view of the carrying case of FIGS. 1 and 2 shown in a closed position.
Figure 4:
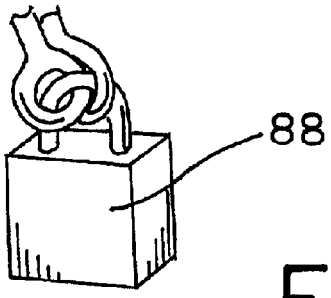
FIG. 4 is an enlarged fragmentary view in perspective illustrating the manner by which the carrying case may be closed with a lock.

As shown in FIG. 3 and 4, the zipper may include a pair of hand pulls, each of which may include an aperture, thus enabling the carrying case 10 to be secured in the closed position of FIG. 3 using a lock 88.

Figure 15:
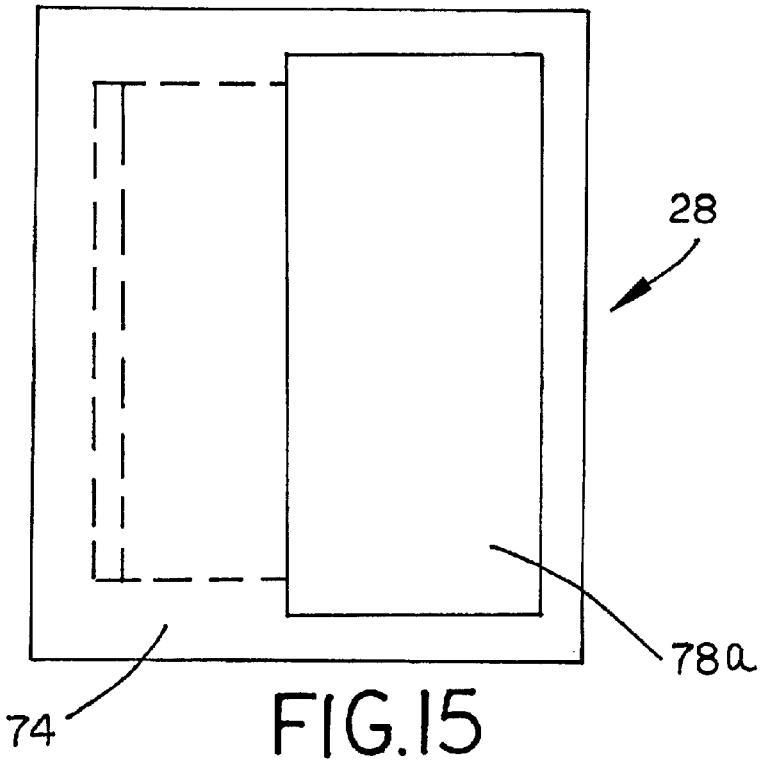
FIGS. 15–17 illustrate additional optional features for use with the disclosed embodiments.
Figure 16:
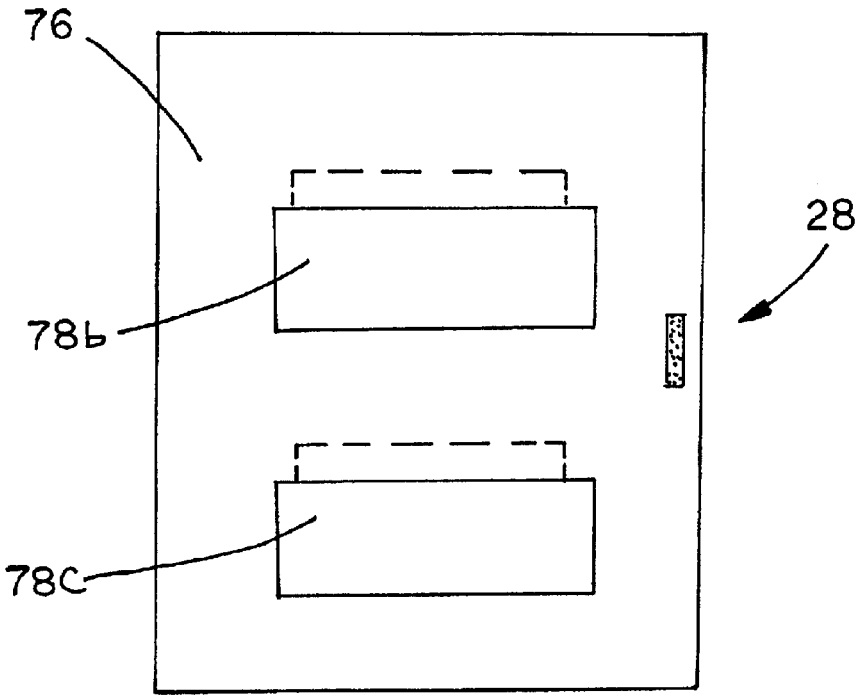

Referring now to FIGS. 15 and 16, the pocket 78*a* may be formed on the face 74 of the divider panel 28, while the pockets 78*b* and 78*c* may be formed on the other face 76 of the divider panel 28. As outlined above, each of the pockets 78*a–c* may be sized to receive written material, such as, by way of examples and not limitations, appointment cards, business cards, medical history information, drug interaction information, and other suitable types of information. Other configurations may be chosen.

Figure 17:
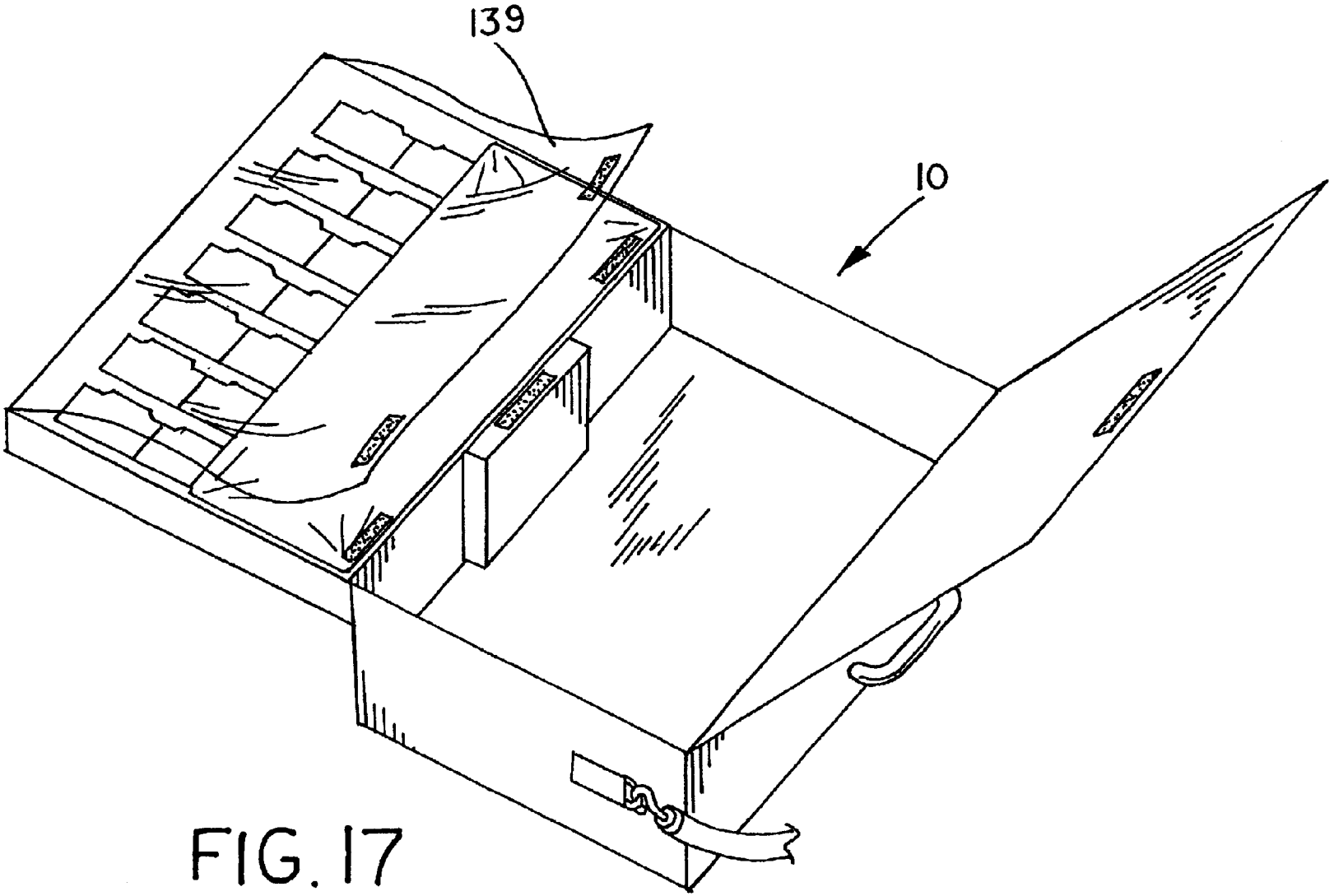
Figure 18:
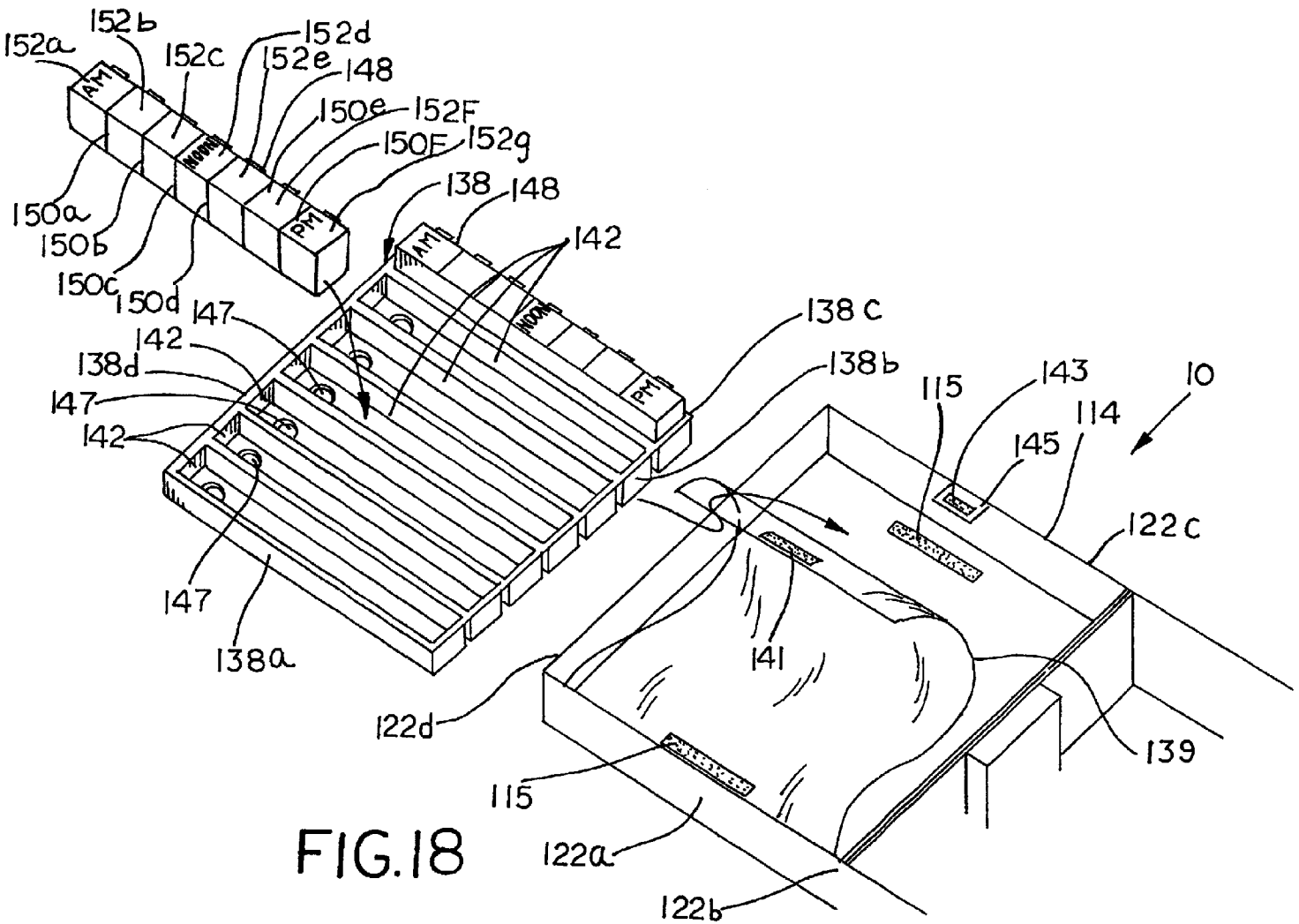
FIG. 18 illustrates another alternate form for the slotted member for receiving the pill inserts.

Referring now to FIG. 18, an alternate form for the slotted member is shown and is referred to by the reference numeral 138. The slotted member 138 includes a plurality of edges 138*a*, 138*b*, 138*c* and 138*d*, and is sized to be removably received in the second compartment 114. In the embodiment of FIG. 18, the slotted member 138 may be secured in the second compartment 114 by a one or more strips 115 of hook and loop closure material, which engage complementary strips (not shown) on the underside of the slotted member 138. Alternatively, or in addition to the hook and loop closures, the slotted member 138 may be secured in the second compartment 114 by the clear vinyl flap 139 secured to any one of the surrounding sidewalls 122*a–d* of the second compartment 114, in this case the sidewall 122*a*, or to another sidewall (FIG. 17). The vinyl flap 139 may include a strip 141 of hook and loop closure material, which engages a corresponding strip 143 on a flap 145 on an opposite one of the sidewalls, in this case the sidewall 122*c*. Alternatively, the slotted member 138 may be frictionally secured in place in the second compartment 114 by friction between the sidewalls 138*a–d* and the surrounding sidewalls 122*a–d* of the second compartment 114.

The slotted member 138 includes a plurality of slots 142, which in the disclosed embodiment are substantially identical. In the embodiment of FIG. 18, seven slots 142 are provided. Each of the slots 142 are sized to receive a pill insert 148. Each of the pill inserts 148 is divided into a plurality of chambers. In FIG. 18, one such pill insert 148 is shown inserted in one of the slots 142, while another such pill insert 148 is shown removed from the slotted member 138. In the disclosed embodiment, the slotted member 138, which is constructed of a rigid plastic material as opposed to foam as discussed above with respect to the first embodiment, may include one or more apertures 147 to enable the inserts 148 to be dislodged from their corresponding slots 142 (when the slotted member 138 has been removed from the second compartment 114). Each of the pill inserts 148 includes a plurality of interior walls, for example, interior walls 150*a*, 150*b*, 150*c*, 150*d*, 150*e*, 150*f*, thus dividing each pill insert 148 into a plurality of chambers, for example, chambers 152*a*–152*g*. The total number of chambers may be customized based on the needs of the user. In the embodiment of FIG. 18, the slotted member 138 and the pill inserts 148 may be purchased as a unit from Apothecary Products of Burnsville, Minn. The pill inserts 148 are also available in a four chamber configuration.

Figure 19:
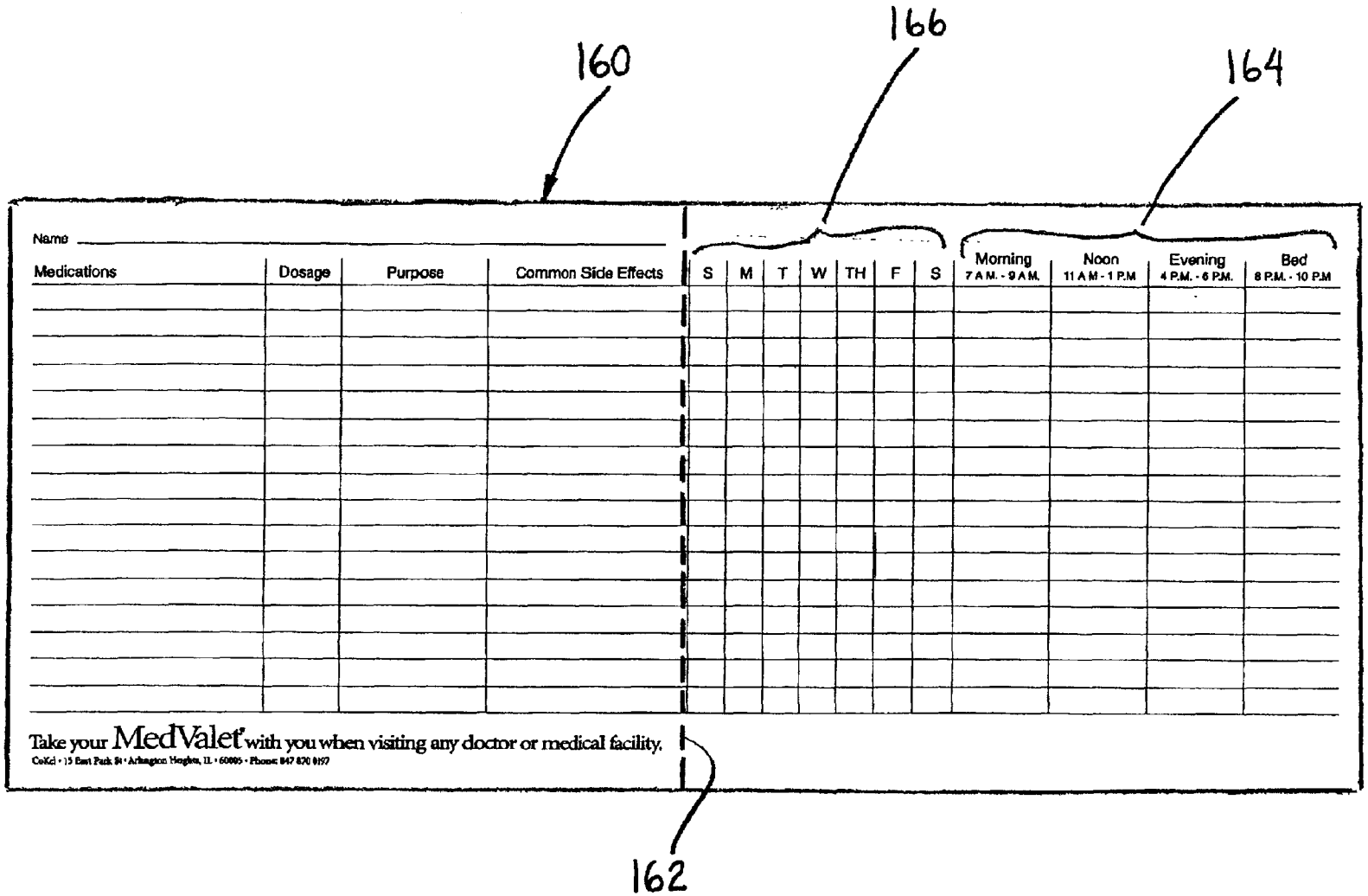
FIG. 19 illustrates an optional eraseable dry board for use with the carrying case of the present invention.

Referring now to FIG. 19, an optional eraseable board or insert 160 may be provided. Preferably, the insert 160 is foldable along a fold line 162, and includes indicia 164 (which may, in the disclosed example, match the indicia 66 discussed above). The insert 160 may also include indicia 166 indicative of the day of the week or any other suitable time increment. As shown in FIG. 19, still other indicia may be provided which may prove suitable to the user.

An optional pen or other writing instrument may be provided. The pen (not shown) may be conveniently attached to any available surface in the carrying case disclosed herein such as by, for example, a hook and loop closure mechanism, an elastic strap, a pocket, or by any other suitable means of attachment.

From the foregoing, persons of ordinary skill in the art will readily appreciate that the disclosed device provides a system for transporting and organizing medication. By virtue of this system, all medication and medical information can be transported to, for example, a treating physician's office, an emergency room, or the like, thereby providing the treating physician, paramedics, or any other health care provider with information concerning the patient's treatment and minimizing the likelihood of over medicating the patient and/or providing the patient with conflicting medications. The disclosed system also provides a reminding mechanism wherein pills are organized into dosages for specific periods thereby facilitating proper following of medication treatment plans. At the same time, the disclosed system provides a convenient storage facility for bulk medications, whether they are in pill, liquid, powder, or gel form.

Those skilled in the art will appreciate that, although the teachings of the invention have been illustrated in connection with certain embodiments, there is no intent to limit the scope of this patent to such embodiments. On the contrary, the intention of this patent is to cover all modifications and embodiments fairly falling within the scope of the appended claims either literally or under the doctrine of equivalents.

What is claimed:

1. A carrying case for carrying and organizing medication, the carrying case comprising:

a first compartment having a first depth;

a second compartment having a second depth shallower than the first depth of the first compartment, the second compartment having a plurality of parallel slots formed in a foam member, the first and second compartments hinged connected together on a first side of the case and shiftable relative to each other between an open position and a closed position, the first and second compartments disposed in confronting relationship when the first and second compartments are in the closed position;

seven inserts, each of the inserts being removably insertable into a corresponding one of the slots of the second compartment, each of the inserts being divided into a plurality of individual chambers, each of the individual chambers having a separate openable lid, and wherein each of the inserts includes indicia thereon corresponding to a day of the week; and a divider panel hingedly connected to the first compartment on a second side of the case opposite the first side of the case, the divider panel having first and second faces, at least one of the first and second faces being adapted to receive written information, the divider panel mounted for shiftable movement between a folded position in which the divider panel is disposed over the first compartment, and an unfolded position in which the divider panel permits access to the first compartment, the divider panel helping to maintain each insert in its corresponding slot when the first and second compartments are in the closed position.

2. The carrying case of claim 1, including a closing mechanism engaging each of the first and second compartments for maintaining the first and second compartments in the closed position.

3. The carrying case of claim 2, wherein the closing device is a zipper.

4. The carrying case of claim 1, including a support disposed in the first compartment, the support supporting the divider panel when the divider panel is in the folded position.

5. The carrying case of claim 1, wherein the divider panel is maintained in the folded position by a hook and loop closure.

6. The carrying case of claim 1, wherein each of the chambers includes indicia thereon corresponding to a time interval during the day.

7. The carrying case of claim 1, wherein at least one of the chambers includes an internal slot, and including a wall removably received in the internal slot, the wall diving the chamber into a pair of subchambers.

8. The carrying case of claim 1, wherein the foam member is removable.

9. The carrying case of claim 8, wherein the slots of the foam member and the inserts are sized so that the inserts are frictionally received in the slots.

* * * * *

UNITED STATES PATENT AND TRADEMARK OFFICE

CERTIFICATE OF CORRECTION

PATENT NO. : 6,848,581 B2
DATED : February 1, 2005
INVENTOR(S) : Richard Cohen

It is certified that error appears in the above-identified patent and that said Letters Patent is hereby corrected as shown below:

Column 6,
Line 9, delete “hinged” and insert instead -- hingedly --.
Line 53, delete “diving” and insert instead -- dividing --.

Signed and Sealed this

Twenty-third Day of August, 2005

JON W. DUDAS
*Director of the United States Patent and Trademark Office*